US008113779B1

(12) United States Patent
Liang

(10) Patent No.: US 8,113,779 B1
(45) Date of Patent: Feb. 14, 2012

(54) TURBINE BLADE WITH TIP RAIL COOLING AND SEALING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 798 days.

(21) Appl. No.: 12/209,523

(22) Filed: Sep. 12, 2008

(51) Int. Cl.
*F01D 5/18* (2006.01)

(52) U.S. Cl. ..... 416/92; 416/97 R

(58) Field of Classification Search ..... 416/92, 416/96 R, 97 R, 228; 415/173.1
See application file for complete search history.

(56) References Cited

U.S. PATENT DOCUMENTS 6,971,851 B2 * 12/2005 Liang ..... 416/1
2010/0008758 A1 * 1/2010 Cunha ..... 415/115

* cited by examiner

*Primary Examiner* — Matthew W Such
*Assistant Examiner* — Ali Naraghi
(74) *Attorney, Agent, or Firm* — John Ryznic

(57) ABSTRACT

A turbine blade with a stepped tip rail extending along the pressure side and the suction side of the blade tip, the stepped tip rail having tip cooling holes in the stepped portion of the tip rail to provide cooling and sealing for the blade tip. The walls of the airfoil include near wall cooling holes that open into a collector cavity formed on the backside of the tip and direct cooling air onto the backside of the tip to provide impingement cooling. The spent air from the near wall cooling holes is collected in the cavity and then discharged out the tip cooling holes. The tip cooling holes are offset inward from the near wall cooling holes to enhance the backside impingement cooling of the tip.

17 Claims, 4 Drawing Sheets

TURBINE BLADE WITH TIP RAIL COOLING AND SEALING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a turbine blade, and more specifically to a turbine blade with tip cooling.

2. Description of the Related Art Including Information Disclosed Under 37 CFR 1.97 and 1.98

In a gas turbine engine, especially an industrial gas turbine engine, the turbine includes stages of turbine blades that rotate within a shroud that forms a gap between the rotating blade tip and the stationary shroud. Engine performance and blade tip life can be increased by minimizing the gap so that less hot gas flow leakage occurs.

High temperature turbine blade tip section heat load is a function of the blade tip leakage flow. A high leakage flow will induce a high heat load onto the blade tip section. Thus, blade tip section sealing and cooling have to be addressed as a single problem. A prior art turbine blade tip design is shown in FIGS. 1-3 and includes a squealer tip rail that extends around the perimeter of the airfoil flush with the airfoil wall to form an inner squealer pocket. The main purpose of incorporating the squealer tip in a blade design is to reduce the blade tip leakage and also to provide for improved rubbing capability for the blade. The narrow tip rail provides for a small surface area to rub up against the inner surface of the shroud that forms the tip gap. Thus, less friction and less heat are developed when the tip rubs.

Traditionally, blade tip cooling is accomplished by drilling holes into the upper extremes of the serpentine coolant passages formed within the body of the blade from both the pressure and suction surfaces near the blade tip edge and the top surface of the squealer cavity. In general, film cooling holes are built in along the airfoil pressure side and suction side tip sections and extend from the leading edge to the trailing edge to provide edge cooling for the blade squealer tip. Also, convective cooling holes also built in along the tip rail at the inner portion of the squealer pocket provide additional cooling for the squealer tip rail. Since the blade tip region is subject to severe secondary flow field, this requires a large number of film cooling holes that requires more cooling flow for cooling the blade tip periphery.

The blade squealer tip rail is subject to heating from three exposed side: 1) heat load from the airfoil hot gas side surface of the tip rail, 2) heat load from the top portion of the tip rail, and 3) heat load from the back side of the tip rail. Cooling of the squealer tip rail by means of discharge row of film cooling holes along the blade pressure side and suction peripheral and conduction through the base region of the squealer pocket becomes insufficient. This is primarily due to the combination of squealer pocket geometry and the interaction of hot gas secondary flow mixing. The effectiveness induced by the pressure film cooling and tip section convective cooling holes become very limited.

This problem associated with turbine airfoil tip edge cooling can be minimized by incorporation of a new and innovated sealing and cooling design into the airfoil tip section design.

BRIEF SUMMARY OF THE INVENTION

It is an object of the present invention to provide for a turbine blade with an improved tip cooling than the prior art blade tips.

It is another object of the present invention to provide for a turbine blade with less leakage across the tip gap than in the prior art blade tips.

It is another object of the present invention to provide for a turbine blade with improved film cooling effectiveness for the blade tip than the prior art blade tips.

It is another object of the present invention to provide for a turbine blade with improved life.

It is another object of the present invention to provide for an industrial gas turbine engine with improved performance and increased life over the prior art engines.

The present invention is a blade tip cooling and sealing design with an offset blade end tip having stepped rail corner built into and along the peripheral of the blade tip. The stepped corner tip rail on the airfoil peripheral will function as cooling air retention as well as a leakage flow deflector.

Cooling air is supplied through radial flow cooling channels formed within the airfoil wall to provide cooling for the airfoil first. The cooling air is then directed onto the backside of the blade tip rail. The spent cooling air is then discharged through the blade tip rail and finally discharged through the airfoil tip peripheral for the cooling and sealing of the airfoil. In this particular cooling design, the blade tip end rail is no longer flush with the airfoil wall but offset from the wall. The tip rail is inline with the peripheral radial cooling flow channels around the airfoil wall. This allows for the impingement cooling air to exit from the cooling channel and impinges onto the backside of the squealer tip rail. This produces a very highly effective means of cooling the blade squealer tip.

In a second embodiment, the radial cooling channels are offset outward from the blade tip discharge holes such that the impinging cooling air is directed onto the backside wall of the blade tip. The spent cooling air is then discharged through the tip rail cooling holes.

DETAILED DESCRIPTION OF THE INVENTION

Figure 1:
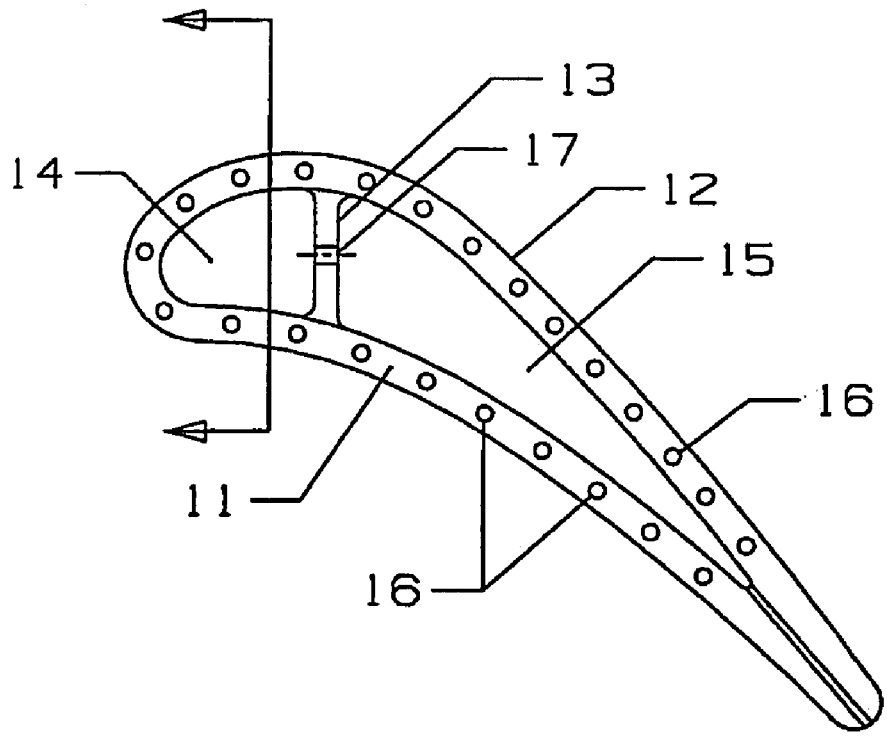
FIG. 1 shows cross section top view of the blade tip cooling circuit of the present invention.
Figure 2:
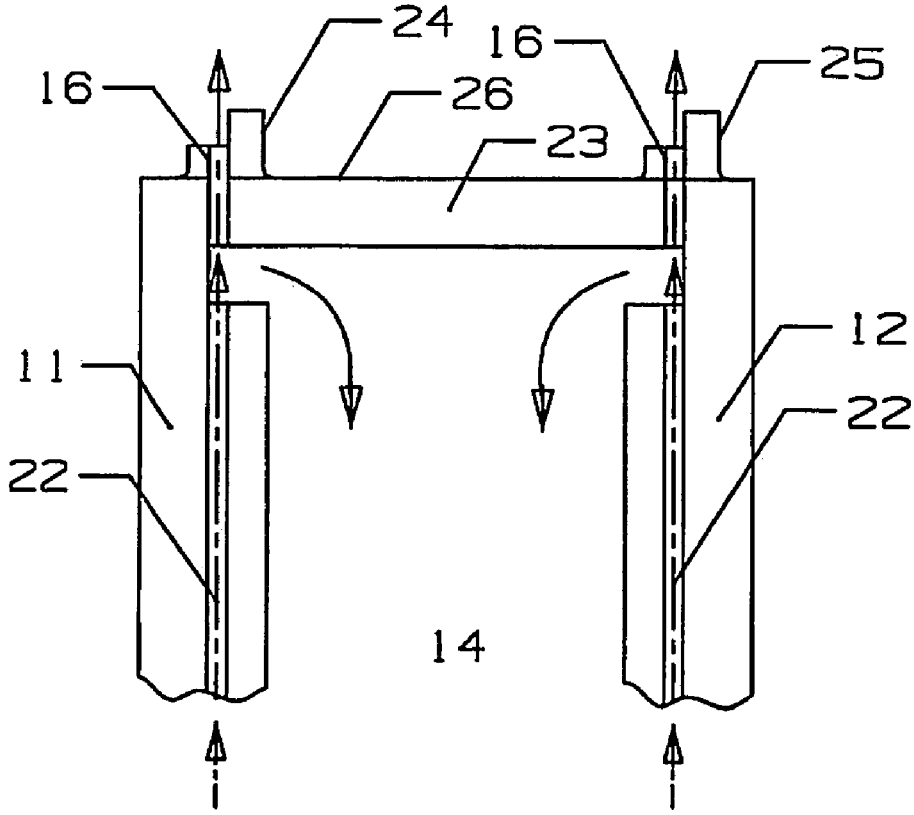
FIG. 2 shows a cross section side view of the blade tip cooling circuit of FIG. 1.
Figure 3:
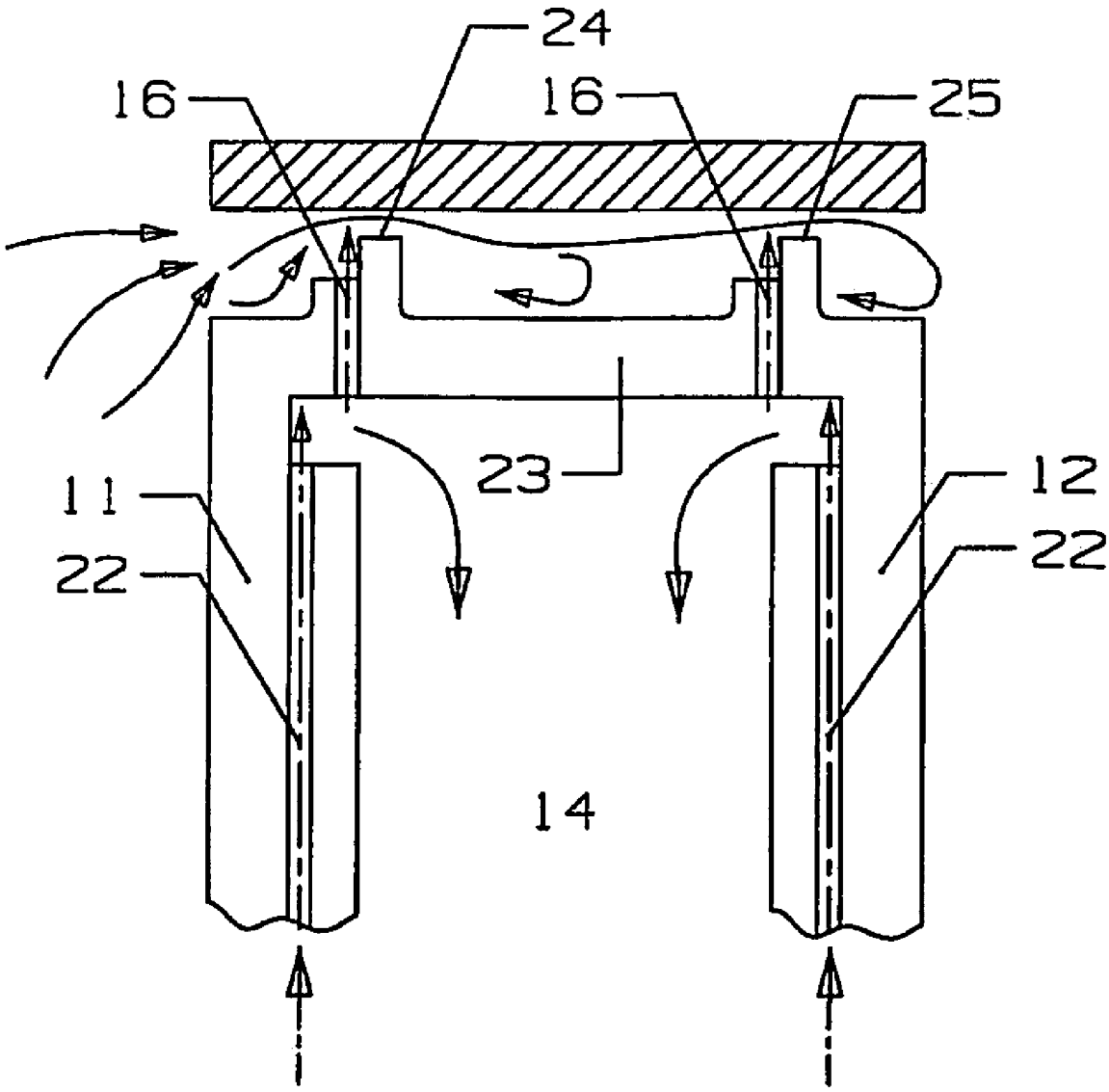
FIG. 3 shows a cross section side view of a second embodiment of the blade tip cooling circuit of the present invention.

The turbine blade with the tip cooling arrangement of the present invention is shown in FIGS. 1 through 3 where in FIG. 1 the blade is divided up into two internal cooling channels 14 and 15 by a separation rib 13 that extends from the pressure side wall 11 to the suction side wall 12. A number of core tie holes 17 (connections between core pieces that hold the pieces together during casting and leave a hole after the ceramic material has been leached away) connects the two channels. However, the present invention can be practiced in a blade having more than two channels, or even in blade in which the channels are not connected by a metering hole through the separation rib. The radial airfoil cooling channels 16 are located within the airfoil walls 11 and 12 and extend from the pressure side near the trailing edge, around the leading edge and end near the trailing edge on the suction side. The airfoil cooling channels 16 are near-wall micro channels to provide cooling for the airfoil walls and to provide cooling and sealing for the blade tip rail as to be described below. In this embodiment, the cooling holes 16 in the tip are offset in the chordwise direction of the airfoil from the cooling holes 22 in the airfoil walls 11 and 12. In another embodiment, cooling holes 16 can be aligned (in the hole axis) with the cooling holes 22. Cooling air exiting hole 22 will spread out in the space defined between the underside of the tip and the opening of hole 22 so that impingement cooling of the underside of the tip will still occur.

FIG. 2 shows a cross section side view of the blade cooling circuit which includes near wall cooling channels 22 in the pressure side and suction side walls 11 and 12. A blade tip 23 includes a pressure side tip rail 24 and a suction side tip rail 25. the tip rails 24 and 25 extend from near the trailing edge and meet up around the leading edge section to form a gap or opening between the two tip rails. The near wall cooling channels 22 open into the internal cooling air collector cavity 14 formed within the blade as seen in FIG. 2. Tip rail cooling holes 16 are located within the tip rails and connect to the collector cavity 14 and discharge cooling air out the tip rails on the forward side. The tip rails 24 and 25 are stepped with the lower step on the forward (upstream) side of the tip rails.

Figure 4:
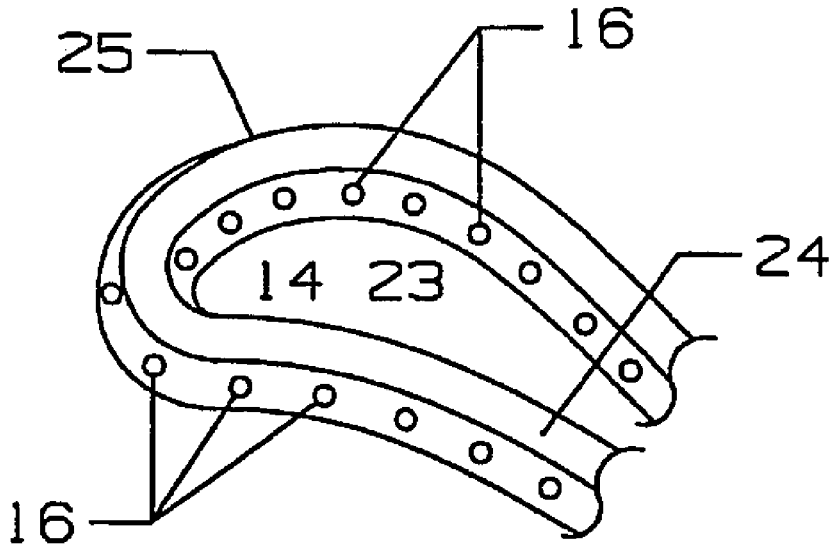
FIG. 4 shows a first embodiment of the stepped tip rail design of the present invention.

FIG. 4 shows a top view of the blade tip cooling design of FIG. 2 in which the tip rails on the pressure side are continuous with the tip rail on the suction side. The stepped portion of the tip rails for both sides are located on the upstream side of the tip rail and merge into the tip rail at around the stagnation point of the airfoil. The tip cooling holes 16 open onto the stepped portion of the tip rail as seen in FIG. 4. The stepped portions of the tip rail on both side of the airfoil merge into the tip rail beyond where the opposite side emerges into the tip rail so that the cooling holes 16 can wrap around the leading edge without an interruption of cooling holes. The cooling holes on the pressure side and the suction side tip rails are spaced about the same, and with the merging of the stepped portions beyond each other on opposite sides the cooling holes spacing can continue around the leading edge.

Figure 5:
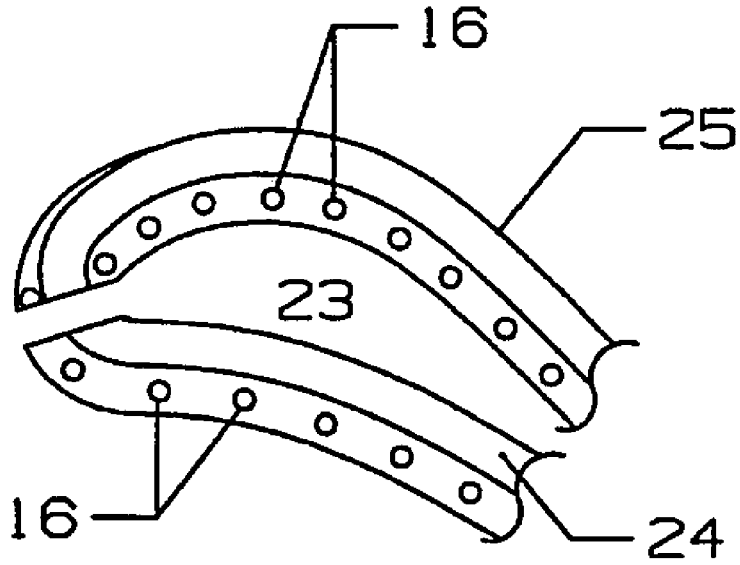
FIG. 5 shows a second embodiment of the stepped tip rail design of the present invention.

Another way of accounting for the continuous tip rail is seen in FIG. 5 in which the tip rail is not continuous but includes a cut section at the stagnation point or the point of the airfoil where the lowest temperature gas flow would enter into the tip pocket. The stepped portions of the tip rails located on the upstream side and at the cut opening. The stepped portions containing the cooling holes 16 could also merge into the tip rail but less space would be available for the cooling holes 16. The tip rail configurations of FIGS. 4 and 5 could be used in either of the embodiments shown in FIG. 2 or 3.

Figure 6:
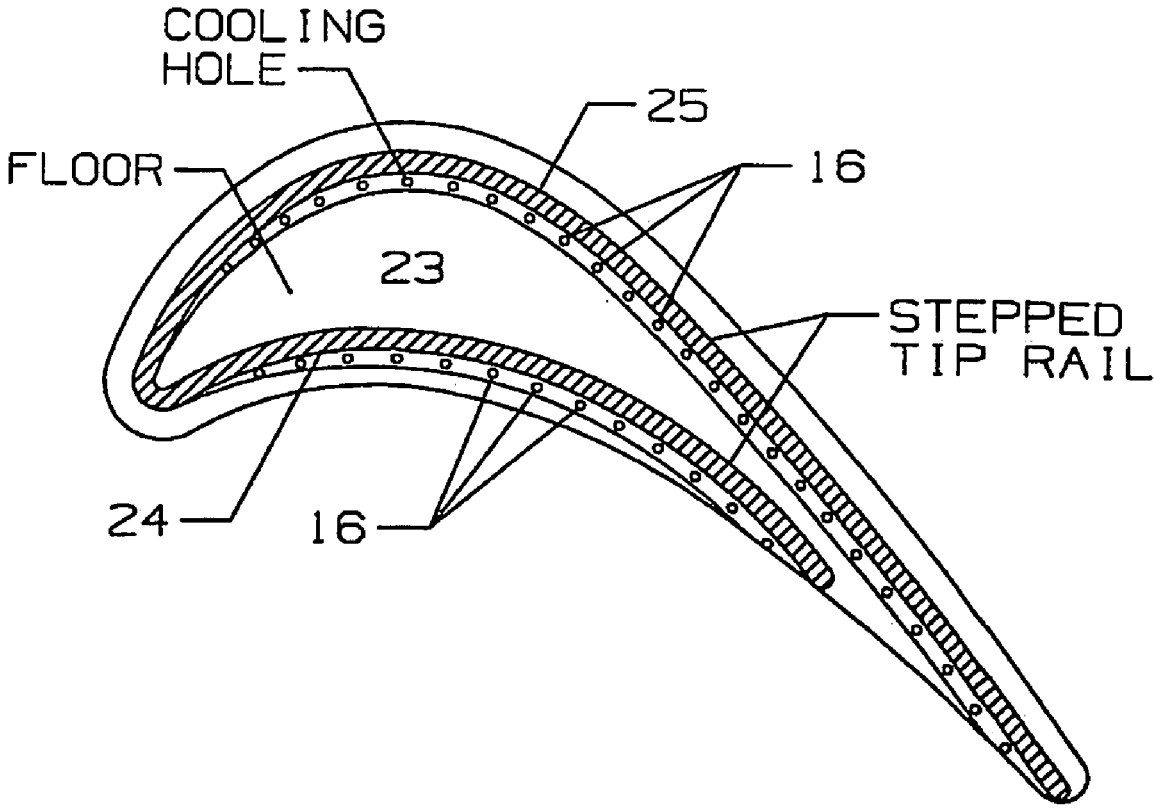
FIG. 6 shows a third embodiment of the stepped tip rail design of the present invention.

FIG. 6 shows still another embodiment for the tip rails with the stepped portion on the upstream side of the tip rail. The tip rail extends from the trailing edge on the pressure side and the suction side and around the leading edge as a single rail with a pressure side rail 24 and a suctions side rail 25 without an opening on the leading edge. The tip rails form a squealer pocket with the tip floor 23. The stepped portions of the tip rail in which the tip cooling holes 16 open are formed on the upstream sides of the tip rails and merge into the tip rails prior to bending around the leading edge of the airfoil as seen in FIG. 6. The tip cooling holes extend along the stepped tip rail portions as far as will be allowed before the stepped portions merge into the tip rails to prevent the formation of a cooling hole. An opening between the tip rails is formed along the pressure side wall near the trailing edge. If warranted, an opening could be formed between the tip rail around the leading edge as in some prior art squealer pockets.

In operation, due to the pressure gradient across the airfoil from the pressure side to the suction side, the secondary flow near the pressure side surface is migrated from lower blade span upward across the blade end tip. The near wall secondary flow will follow the contour of the concave pressure side surface on the airfoil peripheral and flow upward and forward against the oncoming stream-wise leakage flow. This counter flow action reduces the oncoming leakage flow as well as pushes the leakage flow outward to the blade outer air seal. In addition to the counter flow action, the offset blade end tip geometry slows down the secondary flow as the leakage enters the pressure side tip corner and reduces the heat transfer coefficient.

The end result of this design is to reduce the blade leakage flow that occurs at the blade pressure side tip location. As the leakage flows through the pressure side end tip, the cutback stepped tip rail corner with impingement holes will further push the leakage outward. In addition, the last stepped tip rail corner will reduce the effective flow area as the leakage flow entering the second tip rail corner. The secondary flow will swing upward and follow the backside of the stepped blade end tip blocking the oncoming leakage flow. This further reduces the leakage flow across the blade pressure wall. The same flow phenomenon occurs at the blade suction wall end tip rail as well.

FIG. 3 shows a second embodiment in which the cooling channels 22 in the pressure side wall 11 and the suction side wall 12 is offset in a direction normal to the chordwise direction of the airfoil from the tip rail cooling holes 16 in order to directly impinge the cooling air against the backside surface of the blade tip 23. The tip rail cooling holes are offset inward from the FIG. 2 embodiment since the holes in the walls cannot be moved in order to produce the near wall cooling effect. The tip rails on the pressure side 24 and the suction side 25 are also stepped as in the FIG. 2 embodiment with the shorter step on the forward side of the tip rails. The arrows in FIG. 3 represent the hot gas leakage flow interaction phenomena due to the blade end tip geometry effect. In the embodiment of FIG. 3, the cooling holes can also be offset in the chordwise direction as in the FIG. 2 embodiment in order to promote impingement cooling of the tip underside.

Other than the leakage flow reduction due to the blade tip geometry effect, the injection of cooling air also impacts on the leakage reduction. Cooling air is injected into the cutback stepped tip rail corner surfaces as well as on top of the blade end tip from the near wall cooling channel below. The injection of cooling air into the cutback corner surface on the end tip will push the secondary flow outward toward the blade outer air seal. Subsequently, this injection of cooling air will neck down the vena contractor and reduce the effectiveness flow area. The cooling air which is injected on top of the end tip will also block the oncoming leakage flow and further pinch the vena contractor. As a result of both cooling flow injections, the leakage flow across the blade end tip is further reduced.

The creation of these leakage flow resistance phenomena by the blade end tip rail geometry and cooling flow injection yields a very high resistance for the leakage flow path and thus reduces the blade leakage flow and heat load. Consequently, it reduces the blade tip section cooling flow requirement. Major advantages of this sealing and cooling concept over the prior art squealer tip cooling design are: the blade end tip geometry and cooling air injection induces a very effective blade cooling and sealing for both the pressure and suction walls; lower blade tip section cooling air demand to lower blade leakage flow; higher turbine efficiency due to lower blade leakage flow; and reduction of blade tip section heat load due to low leakage flow which increases blade usage life.

I claim the following:

1. A turbine blade for use in a gas turbine engine, the blade comprising: a pressure side wall and a suction side wall; a blade tip forming a cooling air collecting cavity with the pressure side wall and the suction side wall; a plurality of near wall cooling channels in the pressure side wall and the suction side wall, the near wall cooling channels extending in a spanwise direction of the blade and directed to discharge impingement cooling air to the backside wall of the blade tip; a tip rail having a stair step cross sectional shape with a shorter step on the upstream side of the tip rail; and, a plurality of tip rail cooling holes formed within the shorter step of the tip rail and connecting the cooling air collecting cavity to the outer surface of the tip rail.

2. The turbine blade of claim 1, and further comprising: the cooling holes in the tip rail are offset from the near wall cooling holes in the wall.

3. The turbine blade of claim 2, and further comprising: the cooling holes in the tip are offset in a direction normal to the chordwise direction of the airfoil.

4. The turbine blade of claim 2, and further comprising: the cooling holes in the tip are offset from the near wall cooling holes in a direction toward the collector cavity.

5. The turbine blade of claim 1, and further comprising: the cooling holes in the tip rail are aligned with the near wall cooling holes in the wall.

6. The turbine blade of claim 1, and further comprising: the tip cooling holes extend from near the trailing edge on the pressure side, around the leading edge and to near the trailing edge on the suction side at an even spacing and without a break point between adjacent cooling holes.

7. The turbine blade of claim 1, and further comprising: the outlet of the near wall cooling holes in the airfoil walls in located below the backside of the blade tip so that impingement cooling of the backside of the tip is produced.

8. The turbine blade of claim 1, and further comprising: a rib extends from the pressure side to the suction side wall to divide the airfoil into a first collector cavity and a second collector cavity.

9. The turbine blade of claim 1, and further comprising: the stepped portion of the tip rail is about half the height of the non-stepped portion of the tip rail.

10. The turbine blade of claim 1, and further comprising: the tip rail extends from the trailing edge region along the pressure side and the suction side and around the leading edge forming a single tip rail;

the stepped portions of the tip rails merge into the pressure side tip rail and the suction side tip rail before the leading edge of the airfoil.

11. A turbine blade for use in a gas turbine engine, the blade comprising: a pressure side wall and a suction side wall; a blade tip forming a cooling air collecting cavity with the pressure side wall and the suction side wall; a plurality of near wall cooling channels in the pressure side wall and the suction side wall, the near wall cooling channels extending in a spanwise direction of the blade and directed to discharge impingement cooling air to the backside wall of the blade tip; a tip rail having a stair step cross sectional shape with a shorter step on the upstream side of the tip rail, a plurality of tip rail cooling holes formed within the shorter step of the tip rail and connecting the cooling air collecting cavity to the outer surface of the tip rail; and the non-stepped tip rail extends around the leading edge of the airfoil from the pressure side to the suction side; the stepped portion of the tip rail on the pressure side and the suction side both merge into the non-stepped tip rail at a location near the stagnation point of the airfoil.

12. The turbine blade of claim 11, and further comprising: the stepped portion of the tip rail on the pressure side merges into the tip rail beyond the point where the stepped portion of the tip rail on the suction side so that the cooling holes in the tip rail can extend around the leading edge in an evenly spaced order.

13. A turbine blade for use in a gas turbine engine, the blade comprising: a pressure side wall and a suction side wall; a blade tip forming a cooling air collecting cavity with the pressure side wall and the suction side wall; a plurality of near wall cooling channels in the pressure side wall and the suction side wall, the near wall cooling channels extending in a spanwise direction of the blade and directed to discharge impingement cooling air to the backside wall of the blade tip; a tip rail having a stair step cross sectional shape with a shorter step on the upstream side of the tip rail, a plurality of tip rail cooling holes formed within the shorter step of the tip rail and connecting the cooling air collecting cavity to the outer surface of the tip rail; and the stepped tip rail on the pressure side and the suction side are not continuous around the leading edge and produce an opening with the stepped portions of the tip rails ending at the opening.

14. The turbine blade of claim 13, and further comprising: the opening of the tip rails is located at a point on the tip where the lowest temperature gas flow enters the open and into the pit pocket formed by the tip rails.

15. A process for cooling and sealing a blade tip used in a gas turbine engine, the blade tip forming a seal with a blade outer air seal, the process comprising the steps of:

forming a plurality of near wall cooling holes on the pressure side wall and the suction side wall of the airfoil; forming a stair stepped tip rail on the pressure side and on the suction side of the blade tip with the stepped portion on the upstream side of the tip rail; forming tip cooling holes in the stepped portion of the tip rail extending along the pressure side and the suction side of the tip; forming a collector cavity within the airfoil in-between the near wall cooling holes and the tip cooling holes so the cooling holes are not continuous; passing cooling air through the near wall cooling holes to produce impingement cooling of the backside of the tip; collecting the impinging air in the collector cavity; and, discharging the cooling air from the collector cavity out through the tip cooling holes.

16. The process for cooling and sealing a blade tip of claim 15, and further comprising the step of:

offsetting the tip cooling holes from the near wall cooling holes to increase the impingement cooling of the backside.

17. The process for cooling and sealing a blade tip of claim 16, and further comprising the step of:

offsetting the tip cooling holes from the near wall cooling holes in a direction toward the collector cavity.

* * * * *